US006196861B1

(12) United States Patent
Saligny

(10) Patent No.: US 6,196,861 B1
(45) Date of Patent: Mar. 6, 2001

(54) CONNECTOR WITH INTERLOCKING JAWS

(76) Inventor: Yves Saligny, Allée du Docteur Jacques Arnaud, 74300 Thyez (FR)

( * ) Notice: Subject to any disclaimer, the term of this patent is extended or adjusted under 35 U.S.C. 154(b) by 0 days.

(21) Appl. No.: 09/188,380

(22) Filed: Nov. 10, 1998

(30) Foreign Application Priority Data

Nov. 10, 1997 (FR) ..... 97 14080

(51) Int. Cl.[7] ..... H01R 4/24; H01R 4/26; H01R 11/20

(52) U.S. Cl. ..... 439/410; 439/395

(58) Field of Search ..... 439/410, 409, 439/395, 417

(56) References Cited

U.S. PATENT DOCUMENTS

| | | | | |
|---|---|---|---|---|
| 4,153,321 | | 5/1979 | Pombrol . | |
| 4,324,450 | | 4/1982 | Weisenburger . | |
| 4,629,274 | * | 12/1986 | Pollock | 439/410 |
| 4,653,830 | * | 3/1987 | Pegram | 439/395 |

FOREIGN PATENT DOCUMENTS

| | | |
|---|---|---|
| 0067917 | 12/1982 | (EP) . |
| 0419301 | 8/1990 | (EP) . |
| 8910664 | 8/1989 | (FR) . |
| 2747241 | 10/1997 | (FR) . |

* cited by examiner

*Primary Examiner*—Neil Abrams
*Assistant Examiner*—Javaid Nasri
(74) *Attorney, Agent, or Firm*—Young & Thompson

(57) ABSTRACT

A connector of the kind comprising at least two jaws made of a conductive material, which are mounted so that they can move one with respect to the other between two positions, one an open position and the other a closed position and which, each having at least one contact slot formed of two non-touching lips, can interlock when closed by virtue of this contact slot. According to the invention, both, on the one hand, the lips of the contact slot of each of the jaws are, at least locally, oblique to each other, diverging toward the mouth of this contact slot and, on the other hand, closure means capable of holding these jaws in position when closed are associated with these jaws.

23 Claims, 3 Drawing Sheets

CONNECTOR WITH INTERLOCKING JAWS

BACKGROUND OF THE INVENTION

1. Field of the Invention

The present invention relates in general to electrical connectors, whether they be connectors used as one-offs, for example for joining two electric wires together or for connecting such an electric wire to any electrical appliance, for example forming a junction terminal built into this electrical appliance, or whether they be connectors used modularly, in one or more rows, for example in the form of a strip.

It is targeted, more specifically, although not necessarily exclusively, at self-stripping connectors, that is to say at connectors which, intended for connecting at least one insulated electric wire, themselves locally strip this wire by locally displacing its insulating jacket.

2. Description of the Prior Art

More particularly still, the present invention is aimed at connectors of the type that are the subject of the French patent filed on Aug. 8, 1989 under the number 89 10664 and published under the number 2,650,920.

These connectors generally comprise two jaws, at least one of which is made of a conductive material, and which are mounted so that they can move one with respect to the other between two positions, one an open position, in which they are relatively distant from one another, and the other a closed position, in which they are relatively close together, these two jaws each having at least one contact slot by virtue of which they are able to interengaged when closed.

These connectors have, in particular, the advantage that they are simple to use and, when closed, firmly hold the electric wire that they grip and advantageously have only a very small transverse size compared with the wire.

To allow them to adapt to suit electric wires of different diameters, it has been envisaged for the two lips of the contact slot of each of their jaws to be dissociated by making these lips from two parts of such a jaw which are separate from each other.

In fact, given the transverse elasticity of such a jaw, these lips can thus move apart, depending on the diameter of the electric wire engaged between them.

However, to date, the lips of such a contact slot have extended in a straight line parallel to each other along the entire height of this slot.

While, therefore, for a relatively small-diameter electric wire, a relatively small separation between the two lips of such a contact slot will suffice; the same is not true in the case of a relatively large-diameter electric wire.

On the contrary, for such an electric wire, the ability of the two lips of the contact slot to move apart has to be relatively great.

What this means is that in order to accept relatively large-diameter electric wires, the contact slot itself has to be relatively tall, to the detriment of the transverse size of the device as a whole.

SUMMARY OF THE INVENTION

The subject of the present invention is, in general, an arrangement that will make it possible to avoid this drawback and will also lead to other advantages.

More specifically, the subject of this invention is a connector of the kind comprising at least two jaws, at least one of which is made of a conductive material, and which are mounted so that they can move one with respect to the other between two positions, one an open position, in which they are relatively distant from one another, and the other a closed position, in which they are relatively close together, these two jaws each having at least one contact slot formed of two non-touching lips by virtue of which they are able to interengage when closed, wherein both, on the one hand, the lips of the contact slot of each of the jaws are, at least locally, at an angle to one another, diverging toward the mouth of this contact slot and, on the other hand, closure means capable of holding these jaws in position when they are closed are associated with these jaws.

Thanks to the obliqueness, at least locally, of the two lips of the contact slot of each of the jaws with respect to each other, the connector according to the invention can advantageously accommodate a wide range of different diameters for the electric wire that is to be gripped, while at the same time transversely having a relatively modest size.

As a subsidiary effect, while this very obliqueness inevitably causes the jaws to tend to open, because of their transverse elasticity and the fact that they are pressing against the electric wire that they are gripping, the closure means which are also provided according to the invention advantageously counteract this tendency to open.

According to a first embodiment, these closure means come into operation only when the jaws are closed.

For example, these closure means comprise at least two racks each of which is borne by a respective one of the two jaws, and which engage with each other when these jaws are closed.

As an alternative, when the jaws are used inside a box, these closure means may comprise an auxiliary piece which, arranged on a first side with respect to the jaws, is capable of catching on the box on the opposite side of these jaws to the previously-mentioned side.

In either event, it is advantageously possible for the jaws to be opened very easily if, for example, the electric wire that they are gripping needs to be removed.

However, according to another embodiment that can also be envisaged, the closure means provided according to the invention may be permanently in action.

For example, they may comprise an elastic piece which longitudinally grips the two jaws.

In any event, the relative obliqueness of the lips of the contact slot of each of the jaws advantageously leads to a lower deformation force upon contact with the electric wire that is to be gripped, this electric wire positioning itself at a point along such a contact slot which best corresponds to its diameter.

If desired, there may, however, also be provided a stop, which in any case limits the extent to which such an electric wire can enter the contact slot of one and/or other of the jaws, and at which this electric wire thus settles in a good position in this contact slot.

BRIEF DESCRIPTION OF THE DRAWINGS

The features and advantages of the invention will in any case emerge from the description which will follow, by way of example, with reference to the diagrammatic appended drawings in which.

DETAILED DESCRIPTION OF THE PREFERRED EMBODIMENTS

Figure 1:
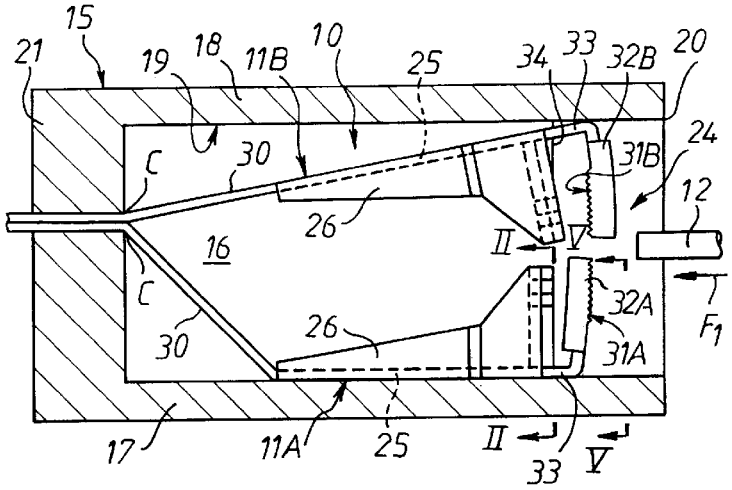
FIG. 1 is a view in elevation/longitudinal section of a connector according to the invention depicted in place in a box with its jaws open.
Figure 2:
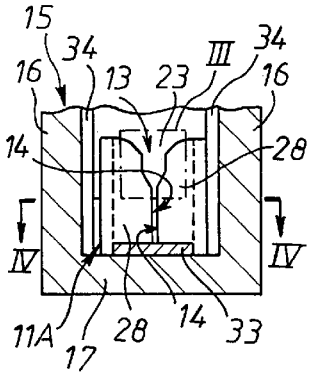
FIG. 2 is a partial view in cross section of the device as a whole, on the line II—II of FIG. 1.
Figure 6:
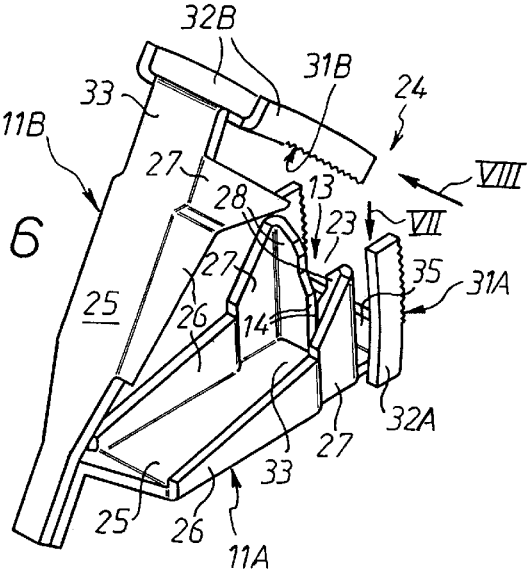
FIG. 6 is a perspective view of the connector according to the invention.
Figure 5:
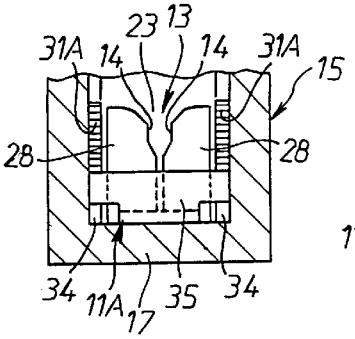
FIG. 5 is an end-on view of this same jaw, in the direction of arrow V of FIG. 1.
Figure 9:
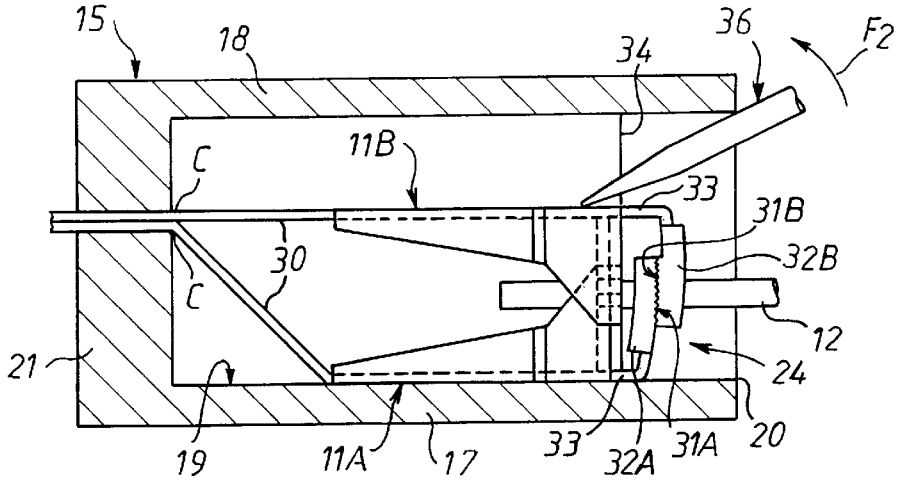
FIG. 9 is a view in elevation/longitudinal section similar to the view of FIG. 1, with the jaws closed.
Figure 10:
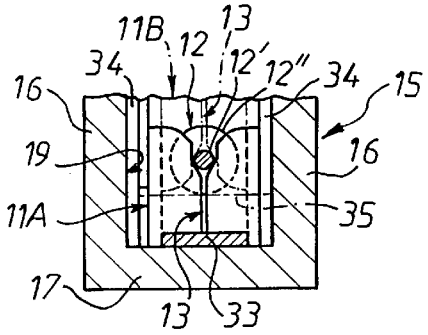
FIG. 10 is a view in cross section illustrating the closure of the connector according to the invention onto an electric wire of relatively small diameter.

As illustrated in these figures, the connector 10 according to the invention, which is an electrical connector, generally comprises two jaws 11A, 11B, at least one of which is made of a conductive material, and which are mounted so that they can move with respect to each other between two positions, one an open position, FIGS. 1 and 6, in which they are relatively distant from each other so that, as depicted diagrammatically by an arrow F1 in FIG. 1, it is possible to axially insert an electric wire 12 between them, the other a closed position, FIGS. 9 and 10, for which they are relatively close together so that, as depicted in these FIGS. 9 and 10, they are then able to grip the electric wire 12 between them, these two jaws 11A, 11B each having at least one contact slot 13 formed of two non-touching lips 14 by virtue of which they can interengage when closed.

For example, and as depicted, the electric wire 12 is an insulated wire, this electric wire 12 having a conducting core 12' and an insulating jacket 12".

However, as an alternative, the electric wire 12 could just as easily be a bare wire.

The two jaws 11A, 11B are, for example, both made of a conductive material, each for example being formed as a single piece from a suitably cut and bent metal sheet.

In the embodiments depicted in FIGS. 1 to 13, they are used inside a box 15 which, for its part, is made of an insulating material and each has just one contact slot 13.

In the embodiment more particularly depicted in FIGS. 1 to 12, the box 15 forms, on the inside, for the connector 10 according to the invention, between two lateral walls 16, a bottom wall 17, a top wall 18, a generally parallelepipedal housing 19 which, at one of its ends, is open in the form of a mouth 20 so that the electric wire 12 can be engaged and which, at its other end, is closed by an end wall 21, in which the jaws 11A, 11B are anchored.

According to the invention, both, on the one hand, the lips 14 of the contact slot 13 of each of the jaws 11A, 11B are, at least locally, oblique to each other, diverging toward the mouth 23 of this contact slot 13 and, on the other hand, closure means 24 capable of holding the jaws 11A, 11B in position when closed are associated with these jaws, in arrangements that are described in greater detail later.

Figure 3:
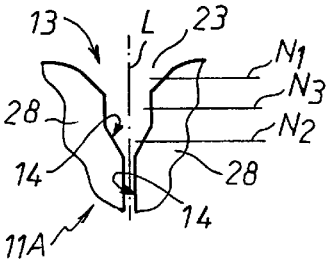
FIG. 3 repeats, to a larger scale, the detail of FIG. 2 that is identified by a box labelled III in this FIG. 2.

In the embodiment more specifically depicted in FIGS. 1 to 12, and as can best be seen in FIG. 3 in the case of the lower jaw 11A, the lips 14 of the contact slot 13 of each of the jaws 11A, 11B are locally oblique to each other at least at two levels N1, N2 of such a contact slot 13, which are staggered along the height of this slot, one relatively close to its mouth 23, the other relatively distant from this mouth 23.

In practice, in this embodiment, the two levels N1, N2 of the contact slot 13 where the lips 14 are oblique to each other are separated by a level N3 where these lips 14 are locally parallel to each other.

In the embodiment depicted, the lips 14 run in a straight line at each of the levels N1, N2, and the same is of course true at the intermediate level N3.

Furthermore, they are, along their entire length, symmetric with one another with respect to the mid-line L of the contact slot 13 that they define.

In the embodiment more specifically depicted in FIGS. 1 to 12, the jaws 11A, 11B have similar constructions.

They each comprise, with a U-shaped or V-shaped transverse profile, a central part 25 and two lateral wings 26 and they have their recessed faces facing each other.

At the same end as the mouth 20 of the housing 19 in the box 15, the lateral wings 26 of each of the jaws 11A, 11B each locally have an extension 27 which, facing toward the other of the jaws 11A, 11B, locally increases its height, and the lips 14 of their contact slot 13 are each respectively formed by the edge face of bent-over portions 28 which face inward from extensions 27 of their lateral wings 26.

As a preference, and as is the case in the embodiment depicted, these bent-over portions 28 extend as far as the central part 25.

In other words, they extend along the entire height of the extensions 27 and of the lateral wings 26.

Furthermore, in practice, these are portions bent at right angles, that is to say bent-over portions which are substantially perpendicular to the lateral wings 26.

Figure 4:
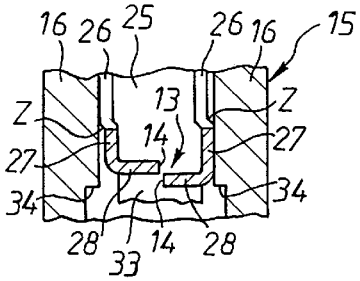
FIG. 4 is a partial plan view of one of the jaws of the connector according to the invention, on the line IV—IV of FIG. 2.
Figure 7:
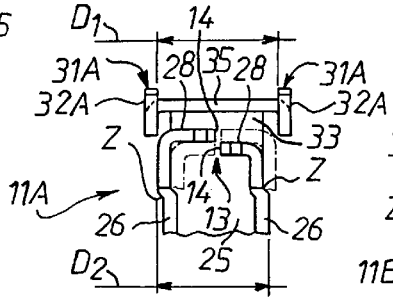
FIG. 7 is, in the direction of arrow VII of FIG. 6, a part view from above of one of its jaws, in this case the one depicted in FIGS. 3 to 5.
Figure 8:
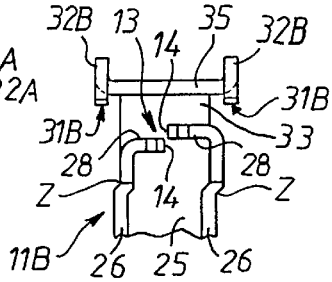
FIG. 8 is a part view from below of the other of these jaws, in the direction of arrow VIII of FIG. 6.

Also as a preference, to allow the contact slots 13 of one of the jaws 11A, 11B to interengage with those of the other and as can best be seen in FIGS. 4, 7 and 8, the bent-over portions 28 forming these contact slots 13 are longitudinally offset from one another.

Finally, as a preference, and to encourage better interengagement of the contact slots 13 of one of the jaws 11A, 11B with those of the other, the lateral wings 26 of each of these jaws 11A, 11B each comprise a dogleg Z which, as can best be seen in FIGS. 4, 7 and 8, locally offsets them sideways, to one side in the case of one of the jaws 11A, 11B and to the other in the case of the other jaw, as depicted diagrammatically in broken line in FIG. 7.

In the embodiment more specifically depicted in FIGS. 1 to 12, the two jaws 11A, 11B are each articulated about a hinge line C which is integral with their central part 25 and which extends transversely with respect to this part.

More specifically, in this embodiment, this hinge line C belongs to an extension 30 of the central part 25 which extends on the opposite side of this part to the mouth 20 of the housing 19 of the box 15 and which, passing through the end wall 21 of this housing 19, for example to be connected to some other electrical component, not depicted, is anchored in this end wall 21, the hinge line C being at the interior surface of this wall.

In the embodiment more particularly depicted in FIGS. 1 to 12, the closure means 24 provided according to the invention comprise at least two racks 31A, 31B each borne by a respective one of the two jaws 11A, 11B.

As a preference, and as depicted, these two racks 31A, 31B are each generally bowed, being centered on the hinge lines C.

In the embodiment depicted, in the case of each of the jaws 11A, 11B, the rack 31A, 31B borne by such a jaw 11A, 11B is formed on the edge face of a bent-over portion 32A, 32B which, integral with an extension 33 of the central part 25 of this jaw 11A, 11B that is situated at the same end as the mouth 20 of the housing 19 of the box 15, and therefore at the opposite end to the previous extension 30, extends approximately parallel to the lateral wings 26 of this jaw 11A, 11B.

In the case of one of the jaws 11A, 11B, in this case the lower jaw 11A, the rack 31A is formed on the external edge face of the bent-over portion 32A which bears it, that is to say on that edge face of this bent-over portion 32A which faces toward the mouth 20 of the housing 19 of the box 15 and, in the case of the other one, therefore in this case the upper jaw 11B, the rack 31B is formed on the internal edge face of the bent-over portion 32B which bears it, that is to say on that edge face of this bent-over portion 32B which faces toward the end wall 21 of the housing 19.

What all this means is that for each of the jaws 11A, 11B, the bent-over portion 32A, 32B bearing the rack 31A, 31B extends beyond the contact slot 13 with respect to the hinge line C.

As a preference, and as is the case in the embodiment depicted, each of the jaws 11A, 11B has two bent-over portions 32A, 32B, on each of which a rack 31A, 31B is formed.

As a preference too, and as is also the case in the embodiment depicted, the distance D1, measured internally, between the two bent-over portions 32A, 32B of a jaw 11A, 11B, FIG. 7, exceeds the overall distance D2, that is to say the distance taking into account the doglegs Z, measured externally, between the two lateral wings 26 of such a jaw 11A, 11B.

The two lateral walls 16 of the box 15 therefore each comprise, transversely, a cut-out 34 which, to allow clearance for the bent-over portions 32A, 32B of the jaws 11A, 11B locally widens the housing 19, near its mouth 20.

In the embodiment more particularly depicted in FIGS. 1 to 12, the extension 33 of the central part 25 of each of the jaws 11A, 11B have, at its end, a rim 35 which extends toward the other jaw 11A, 11B and from which the corresponding bent-over portions 32A, 32B originate.

Figure 11:
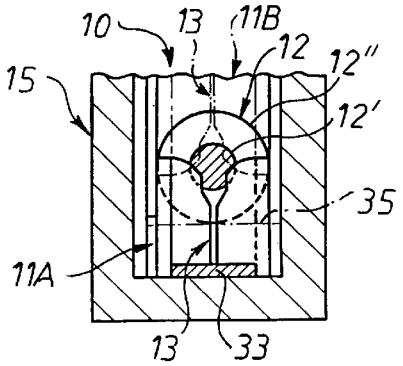
FIG. 11 is a partial view in cross section similar to the view of FIG. 10, for an electric wire of a relatively large diameter.

The free edge of this rim 35 is able transversely to form a stop for the electric wire 12, as is depicted diagrammatically in broken line in FIGS. 10 and 11.

For example, and as depicted, this free edge is straight.

However, as an alternative, it may be somewhat concave.

Finally, the bent-over portion 32A, 32B bearing the racks 31A, 31B of one of the jaws 11A, 11B is longitudinally offset from that of the other jaw, so that they can interact.

More specifically, in the embodiment depicted, the extension 33 of the central part 25 of the upper jaw 11B is longer than the extension of the central part 25 of the lower jaw 11A.

When, with the jaws 11A, 11B open, an electric wire 12 is engaged longitudinally between these jaws, all that is required in order to produce the desired connection, that is to say to clamp these jaws 11A, 11B onto the electric wire 12, is for these jaws to be closed.

For example, and as depicted diagrammatically in FIG. 9, the upper jaw 11B is, in order to do this, pushed toward the lower jaw 11A using a tool 36, for example the blade of a screwdriver which, introduced into the housing 19 of the box 15 by virtue of the mouth 20 thereof, bears against this upper jaw 11B, while at the same time resting against the edge of the top wall 18 of this box 15, as depicted diagrammatically by an arrow F2 in FIG. 9.

While this is happening, the electric wire 12 is forced to engage in the contact slots 13 of the jaws 11A, 11B, and the lips 14 of these jaws therefore cut locally into its insulating jacket 12" until they come into engagement with its conducting core 12'.

When, as depicted in FIGS. 1 to 10, the electric wire 12 is of a relatively small diameter, its conducting core 12' rests against the oblique parts at level two N2 of these lips 14.

As an alternative, FIG. 11, when the electric wire 12 is of a relatively large diameter, this conducting core 12' rests against the oblique parts at level one N1 of these lips 14.

In any case, the bent-over portions 28 forming the lips 14 of the contact slots 13 separate elastically from one another to some extent and this then allows the device as a whole to adapt to suit a relatively wide range of electric wires 12 of different diameters.

In any case too, the free edge of the corresponding rim 35 of the jaws 11A, 11B forms a stop against which the electric wire 12 can ultimately come to rest.

Thus, in the embodiment depicted, the connector 10 according to the invention comprises a stop, in this case 35, which limits the extent to which an electric wire 12 can enter the contact slot 13 of one and/or other of the jaws 11A, 11B.

In any event, finally, the two jaws 11A, 11B interengage therefor to a greater or lesser extent by virtue of their contact slot 13, as described in the abovementioned French patent No. 89 10664.

If the electric wire 12 needs to be released, all that is required is for the racks 31A, 31B of the jaws 11A, 11B to be disengaged from one another.

Figure 12:
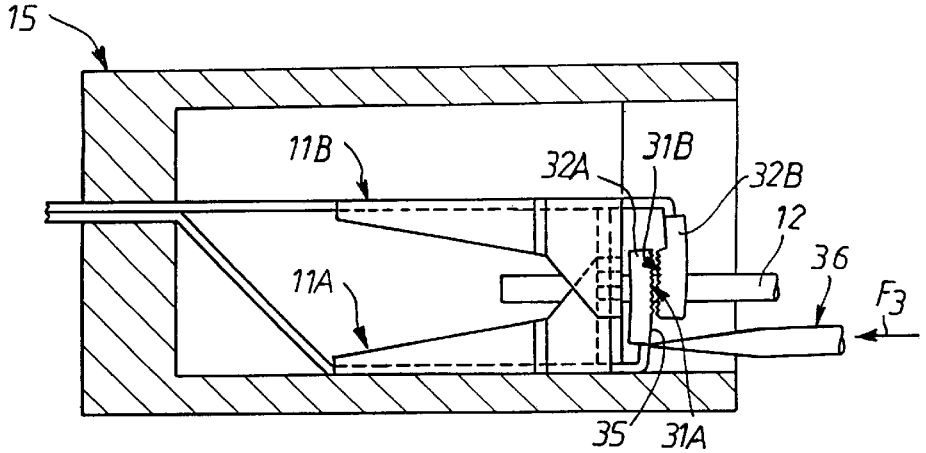
FIG. 12 is a view in elevation/longitudinal section which, similar to the view of FIG. 9, illustrates the disengagement of the two jaws from one another.

For example, and as depicted in FIG. 12, it is possible, in order to do this, to press on the bent-over portions 32A of the lower jaw 11A, using a tool 36, for example the blade of a screwdriver, in the direction of arrow F3 in this FIG. 12, resting this tool 36 against the rim 35 of this jaw 11A.

Figure 13:
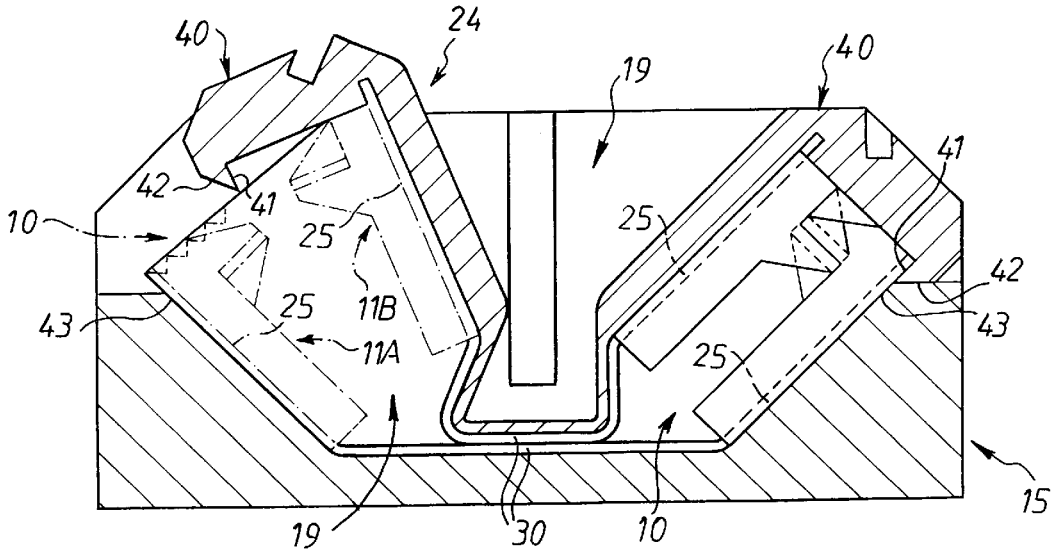
FIG. 13 is a view in elevation/section which, relating to two connectors according to the invention placed back to back, relates to an alternative form of the invention.

In the alternative form depicted in FIG. 13, the closure means 24 provided according to the invention comprise an auxiliary piece 40 which, placed on a first side of the jaws 11A, 11B, is capable of catching on the box 15 on the opposite side of the jaws to the previously-mentioned side.

In order to do this, this auxiliary piece 40 has, at its free end, a clip-in tooth 41 preceded by an engagement chamfer 42, thus being generally hook-shaped and, in conjunction with this, the box 15 has, on its inside, in a corresponding location, at least one clip-in tooth 43.

For example, and as depicted diagrammatically in broken line in the left-hand part of FIG. 13, several clip-in teeth 43 may be provided in series in this box 15, like a rack.

In the embodiment depicted, the box 15 forms two housings 19 back to back, there being a connector 10 and an auxiliary piece 40 in each of these housings, and the extension 30 of the central part 25 of the jaws 11A, on the one hand, and of the jaws 11B, on the other hand, of the connectors 10 are continuous from one of these housings 19 to the other.

Two electric wires, not depicted, can thus be connected together.

For the rest, the arrangements are substantially of the same type as those already described.

Figure 14:
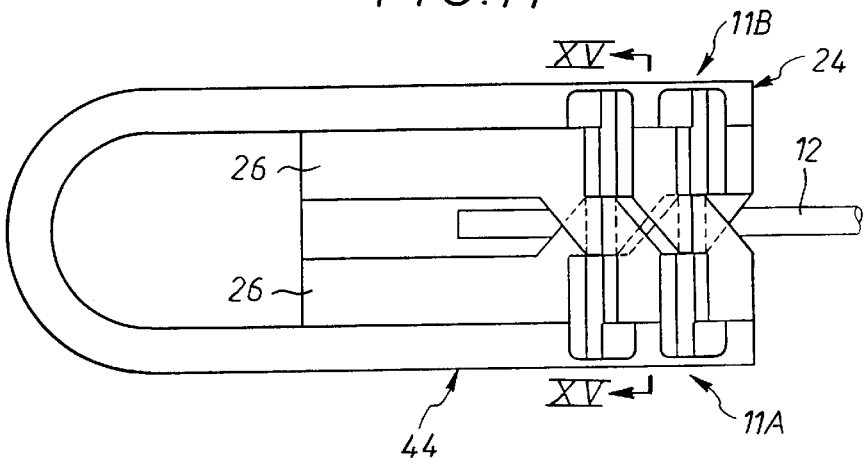
FIG. 14 is a view in elevation relating to another alternative form of the invention.
Figure 15:
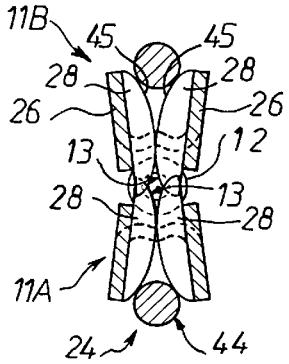
FIG. 15 is a view in cross section of this alternative form, on the line XV—XV of FIG. 14.

In the alternative form depicted in FIGS. 14 and 15, the closure means 24 provided according to the invention comprise an elastic piece 44 which longitudinally grips the two jaws 11A, 11B.

For example, and as depicted, this elastic piece 44 is a hairpin spring made of round wire.

In the embodiment depicted, for each of the jaws 11A, 11B, the elastic piece 44 rests on at least one cam surface 45 integral with this jaw 11A, 11B.

As a preference, and as is the case in the embodiment depicted, each of the jaws 11A, 11B has two cam surfaces 45 and, via its corresponding branch, the elastic piece 44 rests against both of these two cam surfaces 45 at the same time.

In the embodiment depicted, for each of the jaws 11A, 11B, each of the cam surfaces 45 is continuous with one of the lips 14 of the contact slot 13.

In other words, each of the cam surfaces 45 and the lip 14 of the contact slot 13 which is continuous with it are formed by the edge face of one and the same bent-over portion 28 of one of the lateral wings 26 which, as before, are part of the jaws 11A, 11B.

However, in the embodiment depicted, and unlike in the arrangement already described, the jaws 11A, 11B have their recessed faces back to back.

In the embodiment depicted, the cam surfaces 45 are generally convex.

As the lips 14 of the corresponding contact slot 13 are continuous with such cam surfaces 45, they themselves each extend convexly over the entire height of such a contact slot 13 in the case of each of the jaws 11A, 11B.

Rather than coming into operation only when needed, as before, the closure means 24 which consist of the elastic piece 44, permanently urge the two jaws 11A, 11B into their closed position.

Furthermore, in this position in which the jaws 11A, 11B are closed, and because of the cam surfaces 45 against which it bears, this elastic piece 44 advantageously urges the two bent-over portions 28 of each of the jaws 11A, 11B, forming their contact slot 13, to clamp onto the electric wire 12 gripped between these jaws 11A, 11B.

Thus, from this point of view, this elastic piece 44 advantageously has a dual purpose.

For the rest, the arrangements are substantially the same as those previously described.

In particular, when closed, the two jaws 11A, 11B are capable of interengaged therefor to a greater or lesser extent by virtue of their contact slot 13.

Figure 16:
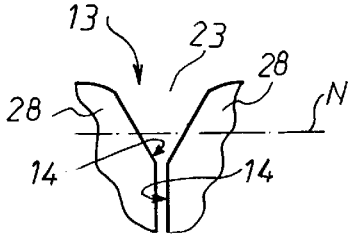
FIG. 16 is a view similar to the view of FIG. 3, for an alternative form of the contact slot of the jaws of the connector according to the invention.

In the alternative embodiment depicted in FIG. 16 which, relating to the contact slot 13 of the jaws 11A, 11B relates more particularly to the embodiments depicted in FIGS. 1 to 13, the lips 14 of the slot 13 of each of these jaws 11A, 11B are locally oblique to each other only at one level N, therefore extending, for example, in a straight line at this level whereas, over the remainder of the height of such a contact slot 13, they extend more or less parallel to each other.

Of course, the present invention is not restricted to the embodiments described and depicted, but encompasses any alternative form and/or combination of their various components.

In particular, when the closure means provided in accordance with the invention are formed of racks, these racks may be on the flanks of the corresponding bent-over portions rather than on their edge faces, as a result, for example, of an appropriate deformation of these bent-over portions.

What is claimed is:

1. A connector comprising at least two jaws, at least one of said jaws being made of a conductive material, said at least two jaws being mounted for movement with respect to each other between an open position in which said at least two jaws are relatively spaced from each other and a closed position in which said at least two jaws are relatively close to each other, each of said at least two jaws having at least one contact slot defined by opposed lips in non-touching relationship, said opposed lips defining a mouth for introducing an electric wire and an oblique portion diverging toward the mouth for accommodating an electric wire, said at least two jaws being interengaged with each other in the closed position, and closure means for holding the at least two jaws in said closed position.

2. The connector as claimed in claim 1, further comprising a stop for limiting the extent of entry of an electric wire into the at least one contact slot of at least one of said jaws.

3. The connector as claimed in claim 1, wherein said opposed lips of each of said jaws are symmetrical about a center line thereof.

4. The connector as claimed in claim 1, wherein said closure means comprise at least one toothed rack borne by each of said jaws and movable therewith, said toothed racks being mutually engaged in said closed position for holding the at least two jaws in said closed position.

5. The connector as claimed in claim 4, wherein each of said jaws has a U- or V-shaped profile and comprises a central part and two lateral wings, said central part having an extension integral therewith and approximately parallel to said lateral wings, each of said toothed racks extending generally transversely to said central part and joined to said extension.

6. The connector as claimed in claim 5, wherein each of said extensions includes a bent-over portion extending towards each other, one of said toothed racks being provided on inner face one of the bent-over portions and the other of said toothed racks being provided on an outer face of the other of the bent-over portions.

7. The connector as claimed in claim 5, wherein each of said jaws is articulated about a transversely extending hinge line integral with the central part, said toothed racks being disposed beyond said contact slots relative said hinge lines.

8. The connector as claimed in claim 5, wherein said V- or U-shaped profiles of said jaws open towards each other.

9. The connector as claimed in claim 8, wherein each of said lateral wings of said jaws have extensions, said extensions of said lateral wings of one of said jaws being directed towards the other of said jaws, said lips of said contact slots of each of said jaws being defined by edges of bent-over portions directed inwardly from said extensions of said lateral wings.

10. The connector as claimed in claim 8, wherein each of said lateral wings of each of said jaws includes a dogleg, said doglegs of one of said jaws being laterally offset in one direction and said doglegs of other of said jaws being laterally offset in an opposite direction.

11. The connector as claimed in claim 10, wherein said elastic member comprises a hairpin spring.

12. The connector as claimed in claim 4, wherein said toothed rack of one of said jaws is longitudinally offset relative to the toothed rack of the other of said jaws.

13. The connector as claimed in claim 4, wherein each of said jaws has two said toothed racks on respective bent-over portions of the respective jaws.

14. The connector as claimed in claim 13, wherein the distance between said two bent-over portions of each of said jaws exceeds the distance between said two lateral wings of the same jaw.

15. The connector as claimed in claim 1, wherein each of said jaws having a U- or V-shaped profile and comprises a central part and two lateral wings, said central part having an extension integral therewith and approximately parallel to said lateral wings, each of said toothed racks extending generally transversely to the respective central part and joined to said extension, each of said extensions having a rim at a free end thereof, said rim of one of said jaws extending toward the other of the jaws, said rims defining stop means for limiting entry of an electric wire into the at least one contact slot.

16. A connector comprising at least two jaws, at least one of said jaws being made of a conductive material, said at least two jaws being mounted for movement with respect to each other between an open position in which said at least two jaws are relatively spaced from each other and a closed position in which said at least two jaws are relatively close to each other, each of said at least two jaws having at least one contact slot defined by opposed lips in non-touching relationship, said opposed lips defining a mouth for introducing an electric wire and an oblique portion diverging toward the mouth for accommodating an electric wire, said at least two jaws being interengaged with each other in the closed position, and closure means for holding the at least two jaws in said closed position, said at least two jaws being housed inside a box including two lateral walls, each of said lateral walls having a transverse cut-out.

17. A connector comprising at least two jaws housed in a box, at least one of said jaws being made of a conductive material, said at least two jaws being mounted for movement with respect to each other between an open position in which said at least two jaws are relatively spaced from each other and a closed position in which said at least two jaws are relatively close to each other, each of said at least two jaws having at least one contact slot defined by opposed tips in non-touching relationship, said opposed lips defining a mouth for introducing an electric wire and an oblique portion diverging toward the mouth for accommodating an electric wire, said at least two jaws being interengaged with each other in the closed position, and closure means for holding the at least two jaws in said closed position, said closure means including an auxiliary member disposed on one side of said at least two jaws and a portion on an opposite side of said at least two jaws cooperable with said auxiliary member for holding said at least two jaws in said closed position.

18. A connector comprising at least two jaws, at least one of said jaws being made of a conductive material, said at least two jaws being mounted for movement with respect to each other between an open position in which said at least two jaws are relatively spaced from each other and a closed position in which said at least two jaws are relatively close to each other, each of said two jaws having at least one contact slot defined by opposed lips in non-touching relationship, said opposed lips defining a mouth for introducing an electric wire and an oblique portion diverging toward the mouth for accommodating an electric wire, said at least two jaws being interengaged with each other in the closed position, and closure means for holding the at least two jaws in said closed position, said closure means comprising an elastic member extending longitudinally of said jaws and urging said jaws towards each other.

19. The connector as claimed in claim 18, wherein each of said jaws include a cam surface integral therewith, said elastic member being in engagement with said cam means.

20. The connector as claimed in claim 19, wherein said cam means of each of said jaws is continuous with one of said lips of said contact slot of the same jaw.

21. The connector as claimed in claim 20, wherein each of said jaws has a U- or V-shaped profile and comprises a central part and two lateral wings, said cam surface and said lip of said one contact slot being defined by an edge of a bent-over portion of one of said lateral wings.

22. The connector as claimed in claim 21, wherein each of said jaws has two cam surfaces.

23. The connector as claimed in claim 22, wherein said U- or V-shaped profiles of the respective jaw open away from each other.

* * * * *